US005222808A

United States Patent [19]

Sugarman et al.

[11] Patent Number: 5,222,808

[45] Date of Patent: Jun. 29, 1993

[54] CAPILLARY MIXING DEVICE

[75] Inventors: Jeffrey Sugarman, Sunnyvale; Ian Gibbons, Portola Valley, both of Calif.

[73] Assignee: Biotrack, Inc., Mountain View, Calif.

[21] Appl. No.: 867,155

[22] Filed: Apr. 10, 1992

[51] Int. Cl.[5] ..... B01F 13/08

[52] U.S. Cl. ..... 366/274

[58] Field of Search ..... 366/273, 274; 422/99, 422/100, 102, 101; 435/287, 315, 316

[56] References Cited

U.S. PATENT DOCUMENTS

| | | | |
|---|---|---|---|
| 3,799,742 | 3/1974 | Coleman | 23/253 |
| 4,054,270 | 10/1977 | Gugger | 366/273 |
| 4,233,029 | 11/1980 | Columbus | 23/230 |
| 4,426,451 | 1/1984 | Columbus | 436/518 |
| 4,618,476 | 10/1986 | Columbus | 422/100 |
| 4,728,500 | 3/1988 | Higo | 422/99 |
| 4,756,884 | 7/1988 | Hillman et al. | 422/73 |
| 4,876,069 | 10/1989 | Jochimsen | 366/274 |
| 4,946,795 | 8/1990 | Gibbons et al. | 436/179 |
| 5,028,142 | 7/1991 | Ostoich et al. | 366/273 |
| 5,077,017 | 12/1991 | Gorin et al. | 422/100 |

*Primary Examiner*—Robert W. Jenkins

*Attorney, Agent, or Firm*—Cooley Godward Castro Huddleson & Tatum

[57] ABSTRACT

A capillary mixing device, comprising a liquid impervious housing; an interior space in the housing comprising a chamber in the housing having capillary spacing in one dimension and non-capillary spacing in other dimensions; and a plurality of magnetic or magnetically inducible particles in the chamber. The chamber is normally accessed through one or more capillary passageways leading to a surface of the housing and is adapted to be retained by a magnetic device that comprises means for generating a moving magnetic field and means for retaining the chamber device in an orientation so that the magnetic field has a field vector that intersects the capillary chamber perpendicular to the dimension having capillary spacing.

21 Claims, 3 Drawing Sheets

CAPILLARY MIXING DEVICE

TECHNICAL FIELD

This invention is directed to mixing of small volumes of liquid confined in containers sufficiently small that bulk flow in the container is limited to the laminar regime, where viscous forces dominate and inertial effects are minimal.

BACKGROUND

The rate of mixing of two liquids, the rate of dissolution of a solute in a liquid or, the homogenization of a dissolved solute in a liquid is based on the diffusion coefficients of the components, which are relatively invariable, and the flow field the fluid experiences. Thus, in systems where mixing is required, optimization of the mixing process requires an appropriate choice of fluid flow conditions. The most efficient mixing conditions are those where there is a high degree of turbulence, which takes the form of randomly swirling eddies that stretch out nonhomogeneous fluid elements and allow diffusion to take place over a very short distance, thereby providing homogeneity. However, in some devices, particularly those with small volumes, closely spaced walls, and/or capillary spaces, the range of fluid flow conditions achievable is severely limited by the viscosity of the fluid or by the dimensions of the system so that turbulence cannot be easily achieved.

In large containers a moving mixing bar or blade induces bulk movement of liquid, which results in mixing of the entire volume of the container. A well-known example of this physical phenomenon is seen in the bulk mixing that occurs as a result of magnetically induced movement of a stir bar at the bottom of a flask or beaker. In contrast, a small mixing bar that rotates in a capillary space formed by two surfaces spaced a small distance apart will mix only the volume that the bar sweeps out, since drag associated with liquid/wall contact prevents transport of momentum (motion) through the fluid by inertia of the liquid.

Diagnostic devices that use capillary flow to transport blood into the interior of the device for mixing with reagents and provide for analysis of a component or property of the blood are examples of small containers that require good mixing under difficult conditions. For example, good mixing is desirable in small rectangular chambers of such assay devices where blood and an aqueous or dry reagent must be quickly and efficiently mixed together. A chamber volume of 155 microliters is typical of some such assays, with dimensions of the chamber being 0.14 inch deep, 0.39 inch length, and 0.175 inch height. In this case a steel ball with a diameter of approximately 0.1 inches can be used to agitate the fluid by rapid back and forth movement under the influence of a magnetic field. The Reynolds number (which relates the ratio of inertia to viscous forces) for flow around the ball is approximately 600 under these circumstances, which indicates a regime where there are significant mixing eddies behind the ball as it moves. In this case, the ball comprises approximately 5% of the chamber volume, but even so, after multiple, passes of the ball, all of the fluid has experienced the mixing action. This is thus an example of a small volume that is still sufficiently large for traditional mixing techniques to be used. See, for example, U.S. Pat. No. 5,028,142, assigned to the assignee of the present application.

In contrast with the previous example, another more extreme assay situation that required the attention of the present inventors involved a cylindrical capillary space, flat on top and bottom, with a depth of 0.012 inch and a diameter of 0.28 inch (volume=12 microliters); dry reagent in this chamber needed to be mixed with whole blood after it flowed by capillary action into the chamber. If mixing were attempted magnetically with a steel ball having a diameter of 0.006 inch (i.e., one-half of the chamber height) and moving at the same speed as in the previous example, the mixing would be inefficient for a number of reasons (1) the ball is now only 0.015% of the chamber volume; (2) the Reynolds number, reduced to 10 because of the smaller ball and greater viscosity of the fluid, signifies a reduction in eddy mixing; and (3) the ball would be more difficult to oscillate because the magnetic force driving its motion decreases according to its mass (resulting in 4600-fold less driving force than in the previous example), whereas the friction force which opposes the motion decreases proportionally to the diameter of the ball and increases because of the more viscous fluid (resulting in only 4-fold less friction force than the previous example). Such physical constraints on forces present in small mixing systems therefore discourage mixing with magnetic or magnetically inducible materials in small spaces, such as capillary spaces.

Accordingly, a new technique for mixing in capillary spaces is desirable.

Relevant Literature

A number of devices exist for determining analytes in small volumes of sample using disposable cartridges and analytical instruments suited to "patent-side". U.S. Pat. No. 4,756,884 describes methods and devices using capillary flow tracks for analyzing samples for the presence of analytes or for the properties of the samples, such as clotting rates of blood samples. Analytical cartridges capable of carrying out more than one analysis in a single disposable cartridge are described in U.S. patent application Ser. No. 348,519, filed May 8, 1989, now abandoned. U.S. Pat. No. 4,233,029 describes a liquid transport device formed by opposed surfaces spaced apart a distance effective to provide capillary flow of liquid without providing any means to control the rate of capillary flow. U.S. Pat. Nos. 4,618,476 and 4,233,029 describe a similar capillary transport device having speed and meniscus control means. U.S. Pat. No. 4,426,451 describes another similar capillary transport device including means for stopping flow between two zones, flow being resumed by the application of an externally-generated pressure. U.S. Pat. No. 3,799,742 describes an apparatus in which a change in surface character from hydrophilic to hydrophobic is used to stop flow of a small sample, thereby metering the sample present. U.S. Pat. No. 5,077,017 and U.S. Pat. No. 4,946,795, both of which are assigned to the same assignee as the present application, described a number of dilution and mixing cartridges in which mixing takes place in small capillary and non-capillary spaces. In the mixing spaces described, mixing is accomplished using a unitary mixing bar designed to closely fit the chamber.

SUMMARY OF THE INVENTION

It is an object of the present invention to provide devices and systems that will allow complete mixing to occur in capillary spaces while avoiding the design constraints imposed by close-fitting, full volume mixing bars. These and other objects of the invention as will hereafter become readily apparent have been accomplished by providing a capillary mixing device comprising a liquid impervious housing, an interior space in the housing (a chamber) having capillary spacing in one dimension and non-capillary spacing in other dimensions, and a plurality of magnetic or magnetically inducible particles in the chamber. The chamber is normally accessed through one or more capillary passageways leading to a surface of the housing so that liquids can enter and gases can be vented from the device. The chamber-containing device is adapted to be retained by a magnetic device that comprises means for generating a moving, preferably rotating, magnetic field and means for retaining the chamber device in an orientation so that the moving magnetic field has a magnetic field vector oriented to impart the motion to particles in the mixing chamber. In reality, the necessary condition for motion of the magnetic particles is the presence of a magnetic gradient; however, since this is most commonly produced by motion of a magnet or similar magnetic field generator, the phrase "moving magnetic field" is used here to indicate the desired condition, however generated.

The magnetically induced motion of the particles is more than mere alignment/non-alignment of particles resulting from on/off states of an electromagnet or similar device, since the motion must provide for efficient mixing by translational movement of the liquid to be mixed along with the particles. The particles thus preferably move several to many times their own length, generally hundreds or thousands of times as much as their own lengths.

The magnetic device can also function as a monitor of reactions taking place in the capillary mixing device by incorporating various instrumental systems into the magnetic device. Surprisingly, in view of the well-known reduction in available physical forces for magnetic movement with size, described in the Introduction above, efficient mixing is obtained, as the individual particles aggregate into masses of particles that resemble stirring bars which rotate, break up, and reform into new aggregates as the mixing process continues under the influence of the rotating magnetic field.

DESCRIPTION OF THE DRAWINGS

The present invention will be better understood by reference to the following detailed description of the invention when considered in light of the drawings that form part of the present specification, wherein.

DESCRIPTION OF SPECIFIC EMBODIMENTS

Figure 1:
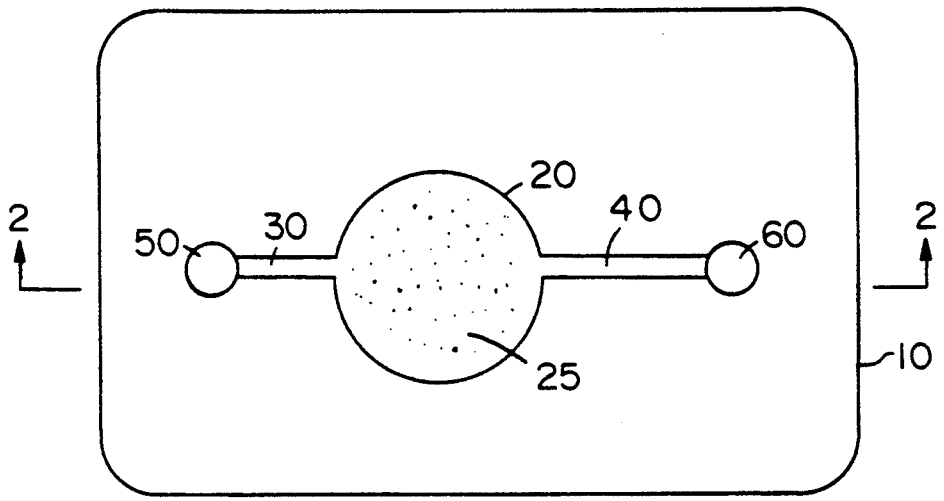
FIG. 1 is a plan view of one embodiment of a capillary mixing cartridge useful in the practice of the present invention.

The present invention provides a method and device for carrying out mechanical mixing of liquids in capillary spaces. Surprisingly, in view of the rapid reduction of forces available to drive small particles relative to friction forces that retard their movement, the mixing can be carried out using a plurality of magnetic or magnetically inducible particles and a moving magnetic field. The particles form temporary aggregates that act like larger mixing bars; when subjected to a rotating magnetic field, the particles often forming a number of small bar-like aggregates that rotate in phase. The bar-like aggregates form, break up upon contact with resistance, and reform to provide an unexpectedly flexible and efficient mixing system for capillary spaces.

A capillary space is considered here to be a chamber of some physical device in which two surfaces are spaced apart at a distance which allows capillary flow through the space. Only one of the three orthogonal dimensions necessarily has this capillary spacing, with the remaining dimensions typically being greater than capillary spacing (a chamber with two orthogonal capillary dimensions would be a capillary tube). The most typical example of a capillary space is formed by two flat plates spaced apart by an appropriate distance, with side walls serving to confine the liquid and to act as spacers between the two surfaces. However, the space can deviate from simple planar form and can undulate significantly, even so that lower surfaces are found at elevations above nearby upper surfaces, if desired. Such chamber shapes, while suitable for the present invention, would not allow ordinary mixing with a stirring bar or similar microscopic mixer.

Typical capillary dimensions for aqueous liquids are from 0.01 to 2.0 mm, preferably 0.05 to 1.0 mm, with typical non-capillary dimensions being larger than 2 mm. The width of the chamber and its length have no maximum, but they are typically small since the goal of such an apparatus is normally to mix small volumes of liquid. Widths are therefore generally less than 30 mm, often less than 20 mm, and the lengths of the mixing chamber are of similar dimensions (but not necessarily equal dimensions; i.e., oval and rectangular shapes are permitted and even preferred for some embodiments).

A passageway leading into or out of the chamber can be of any convenient dimensions, as described in more detail below. In most cases capillary passageways are provided in order to allow access of liquids into and out of the apparatus and to provide for additional handling of liquids in the apparatus at locations other than the mixing chamber while still resorting solely to capillary force and gravity to provide fluid flow. Such passageways are not considered to be part of the chamber, although they will generally form a capillary pathway in combination with the chamber.

Located in the mixing chamber at the time of mixing are numerous small magnetic or magnetically inducible particles that carry out the mixing operation. The particles can be added to the chamber as a suspension in one of the liquids to be mixed or can be present in the chamber when a liquid in introduced. In preferred embodiments, the particles are present together with a reagent composition that will react with some component in the liquid or liquids to be mixed. The reagent composition is one that will dissolve or be suspended in the mixture that is being formed in the mixing chamber.

The particles have a maximum length that is a small fraction of the length or width of the chamber in which mixing takes place. Typically, the particles have a maximum length of less than 0.2 mm and will of necessity have at least one dimension smaller than the capillary spacing of the chamber. No minimum length or preferred shape of particles appears to exist. Particles smaller than a single magnetic domain will work in a mixer of the invention. Examples of typical mixing particles include magnetite, barium ferrite, and so-called "Magic ® particles," which are iron oxide particles covered with a polymeric coat. Other exemplary particles include iron and steel filings.

Several types of magnetizable particles are available commercially for other purposes and can simply be purchased and used for purposes of the invention instead of for their originally intended purpose. For example, the Magic ® reagent system is an assay system that uses such particles to act as support surfaces in immunoassays, with the magnetic properties being used in a step that separates the particles from the liquid portion of the assay mixture. Nevertheless, they can be used to provide mixing as described herein. Other material, such as iron filings, magnetite, and barium ferrite, are available from numerous scientific supply houses, where they have previously been supplied to, among other purposes, visually demonstrate the presence of magnetic fields.

It was found that particles work best when they are not permanently magnetic but are magnetically inducible under the influence of a magnetic field gradient. This property obviates the difficulties of undesirable clumping of particles when they are stored or dispensed. Preferred particles are paramagnetic, defined as a material with magnetic susceptibility $>0$ and relative permeability $>1$. The particles are preferably smaller than the critical size necessary for the particle to be permanently magnetic (which varies with the properties of the particular inducible composition).

The volume of magnetic particles used in the mixing chamber will vary with the desired rate of mixing, viscosity of the fluid, and volume of the chamber. A typical volume occupied by the magnetic particles is from 0.1 to 20% of the volume of the chamber, preferably from 0.5 to 10% of the chamber volume, and more preferably from 1 to 4%. The particles preferably have a density more than that of the liquid in the mixing chamber. Since most solutions are aqueous and have a density of approximately 1 g/ml, particles with a density of 2 g/ml are preferred, more preferably at least 4 g/ml. Since the particles are or contain metal, such densities are easily realized. Even particles coated with plastic (polymeric) materials having a specific density of less than 1 will have an overall density in the indicated size range if the coating is selected to be of appropriate thickness to provide the indicated density.

In formulating a liquid reagent with suspended magnetic mixing particles, reagent additives can be included to adapt the reagent properties to the desired application. For example, where whole blood is to be mixed with a reagent during its transit through the capillary chamber for an assay in which lysis of the red cells in not desired, several qualities are desirable for the formulation:

1. The formulation should not hemolyze blood cells during either the dissolution or the mixing of the reagent.

2. The dry formulation should be readily dissolvable so as to allow dissolution to take place.

3. The formulation should preferably not result in significantly increasing the osmotic pressure of the plasma, which would cause red cell shrinkage and consequent dilution of plasma components to be measured.

4. The additives should preferably not cause interference of the chemistries to be performed.

For example, bovine serum albumin, when added to a reagent composition has been shown to slow flow and enhance re-suspension. Polyethylene glycol and sucrose have been shown to prevent hemolysis and enhance wetability. However, it will be apparent to one of ordinary skill in the art that each mixing application can be optimized for its specific needs, and that the preferred characteristics of the formulations will change from analysis to analysis. For example, when hemoglobin is being measured, hemolysis is a desirable trait, in opposition to the example above. In any event, the preparation of a particular reagent formulation will not modify the present invention, which is directed to the mixing operation itself.

Figure 2:
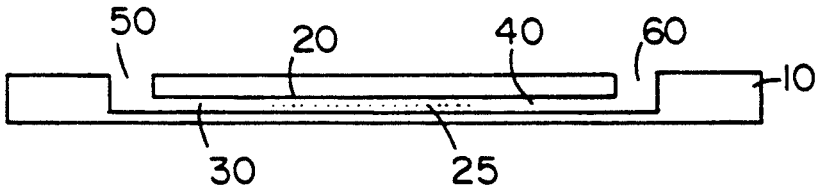
FIG. 2 is a cross-sectional view taken along line A—A of the embodiment shown in FIG. 1.
Figure 3A:
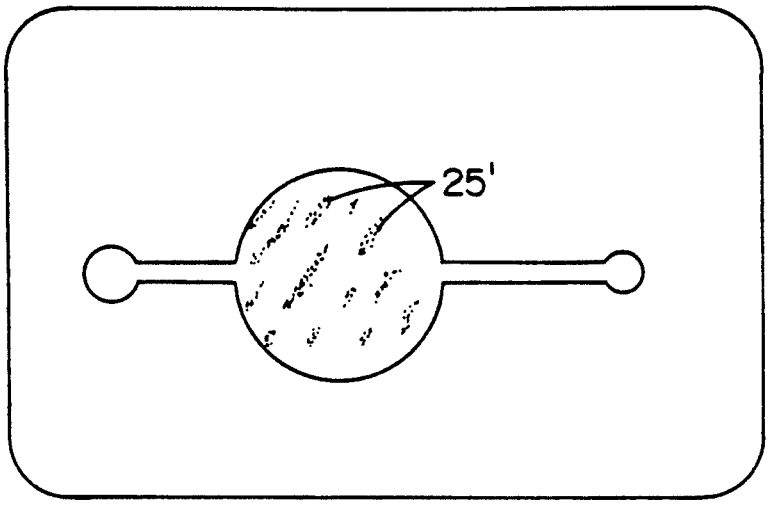
FIG. 3 (panels A-C) provides a series of three views of a system of the invention using a mixing cartridge of the embodiment of FIG. 1 and a monitor, in which panels A and B show instantaneous views during the mixing operation, and panel C shows particles drawn into a sub-region of the chamber by a linear magnetic field after mixing.
Figure 3B:
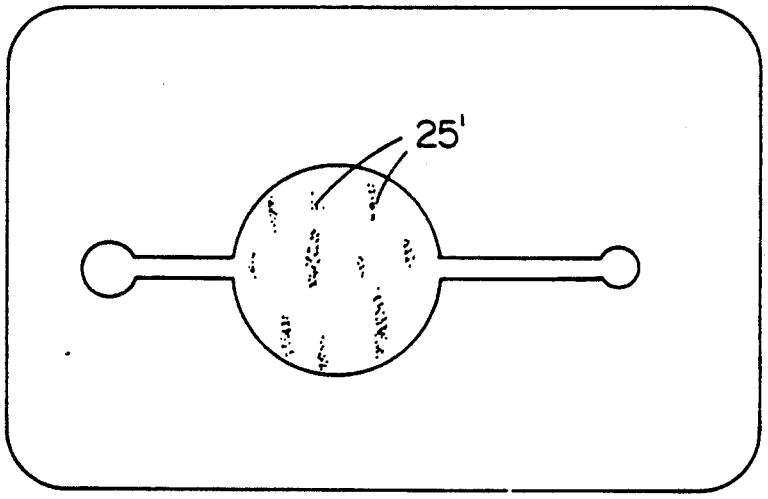
Figure 3C:
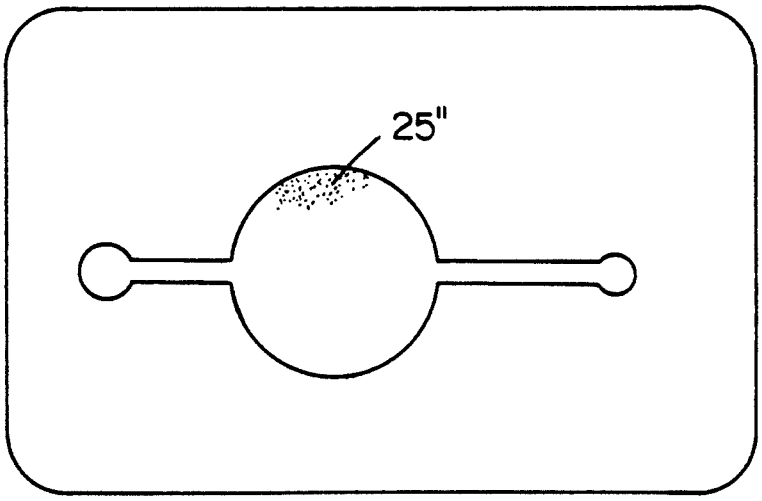

The operation of a mixing device of the invention can readily be understood by references to FIGS. 1–3, which show the basic construction and operation of representative cartridges used in the invention. FIG. 1 is a plan view of a typical device, showing a liquid-impervious housing 10 in which all of the interior chambers of the device are formed. In this embodiment, central chamber 20 in housing 10 contains a plurality of magnetic particles 25. Two capillary passageways are present in the device, an entrance passageway 30 and an exit passageway 40. Entrance (50) and exit (60) holes in the surface of housing 10 are provided in order to allow entrance of liquids and exit of gases, such as air that would otherwise be trapped and prevent capillary flow.

The formation of interior spaces is apparent in FIG. 2, in which the same reference numerals are utilized in a cross-sectional view of the same embodiment as FIG. 1, taken along line A—A of FIG. 1. In FIG. 2, the vertical height of each interior chamber is seen to be of capillary dimensions in order to provide capillary flow throughout the interior of the device. Entrance and exit passageways 50 and 60 are apparent in the top surface of housing 10.

Figure 4:
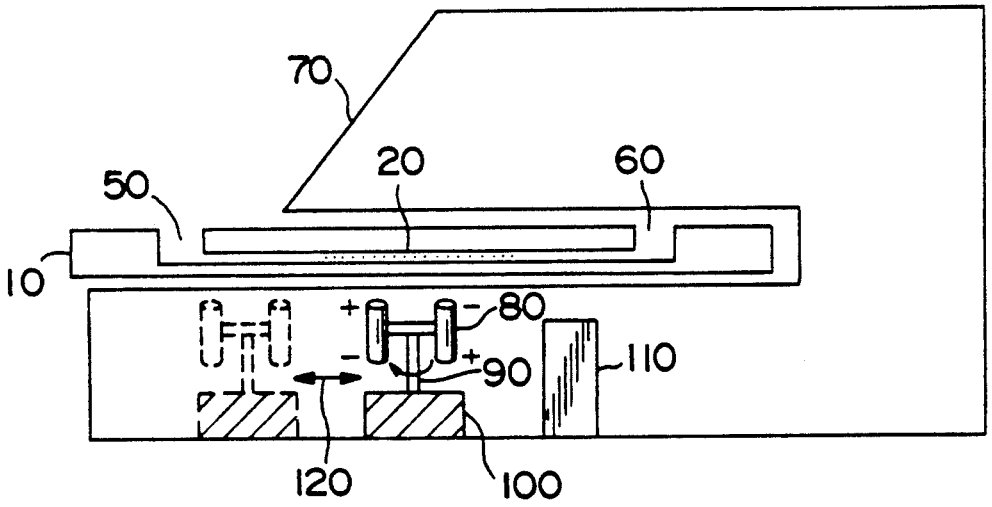
FIG. 4 is a cross-sectional view of one embodiment of the system.

FIG. 4 shows a system of the invention, including a means for generating a moving magnetic field (magnets 80 attached to a rotating shaft 90 of an electric motor 100) mounted in an instrument 70 into which the chamber device 10 is inserted. An optical detection device 110 is shown oriented to interrogate the chamber device at the post-chamber passageway. In FIG. 4, collection is provided by idsplacement of the mixing device as indicated by the arrow 120. The insertion of the chamber device into the slot in the instrument provides a means for retaining the chamber device in proper orientation.

FIG. 3 shows a mixing operation. When the particles are present before mixing takes place, they are typically distributed randomly throughout chamber 20, as shown in FIG. 1. Alternatively the particles can be introduced along with one of the components to be mixed. When a magnetic field is present, the particles align with the magnetic field vector. However, there is no motion or aggregation of particles unless there is motion of the magnetic field. Panels A and B of FIG. 3 shows instantaneous views of the middle of a mixing operation using a rotating magnetic field in which the aggregate clusters are formed into linear aggregates, as shown at 25'. Each of the aggregates rotates about its own central axis in the presence of the rotating magnetic field, and the aggregates are free to break up and reform during the mixing operation, as can be seen by comparing the number and size of the aggregates in Panels A and B (fewer but larger cluster are present in Panel B, as tends to occur over time with mixing). Additionally, the aggregates precess around the mixing chamber so that their centers of rotation move with time. The rotating aggregates thus "walk" around the chamber as they rotate, sweeping out all areas of the chamber and ensuring complete mixing. Accordingly, the presence of irregularities in the mixing chamber or in the liquid or reagent to be mixed do not prevent proper mixing, since the aggregates merely break up and reform upon encountering resistance at any particular location, while persisting in their rotation at the edges of the irregularities until a homogeneous mixture is obtained.

It should be noted that the aggregates that form are not necessarily linear. Other shapes, such as curves and spirals, also occur. The shape of the aggregates appears to be determined by the rotation rate and the viscosity of the liquid being mixed.

Panel C shows a useful feature of the aggregates, since they break up and the individual particles can be collected when the rotating magnetic field ceases and a linear-gradient magnetic field is applied to the particles. As shown at 25'' in panel C of FIG. 3, the particles can be collected at a single location in the mixing chamber. This property could be used, for example, to collect the magnetic particles so that mixed liquid can traverse an exit capillary passageway to another location in housing 10 without carrying particles into that location. Other useful aspects of mass movement of the collected particles are discussed below.

A number of individual components used in the system of the present invention, such as devices that use capillary tracks to transport and analyze liquid samples, have been developed in the laboratories of the assignee of the present inventors and are the subject of other issued patents and currently pending patent applications. Those components of the system that were previously known are described in sufficient detail below to enable one skilled in the art to practice the present invention. Background information and a number of additional details are set forth in the patents and patent applications that originally described these individual aspects of the system and which are incorporated into this specification by reference.

This system typically comprises a single-use, disposable, analytical cartridge, most often made by welding together two or more plastic pieces (usually prepared by injection molding) containing various channels and chambers; sample movement is typically but not necessarily provided by capillary force. The cartridge can contain multiple chambers capable of mixing sample in multiple capillary tracks, multiple chambers in a single track, or only a single chamber in a single capillary track. The capillary tracks comprise (in addition to the mixing chamber) an entry port for entry of sample into the track, a capillary section that provides for sample flow and containment, and a vent to allow trapped air to escape so that capillary flow can take place. In some cases multiple capillary tracks use a common sample entry port; in other cases, entirely separate tracks with separate entry ports are provided.

The capillary sections are generally divided into several subsections that provide for different functions, such as sample flow, dissolution of reagent, analysis of results, verification of proper operation, or venting of air. The geometry of these sections vary with their purpose. For example, dissolution and/or mixing of reagents normally takes place in broad capillary chambers that provide a large surface area to which reagents can be applied and from which they will be rapidly re-suspended or dissolved upon contact by sample. In the present invention, at least one, but not necessarily all, mixing chambers will contain magnetic particles and be used as described herein. Sample flow is normally regulated by the dimensions of the capillary channels and the physical properties of the sample intended for use in a given cartridge. Analysis and verification subsections of the capillary passageways and various chambers will have geometries shaped to cooperate with the detection system being used, such as flat or curved surfaces that cooperate with light passing through the walls of the capillary track so that the light is dispersed, concentrated, or left unaffected, depending on the desired result. For additional description of capillary flow devices with these elements, see U.S. Pat. No. 4,756,884 and U.S. application Ser. Nos. 016,506, filed Feb. 17, 1987, and U.S. Pat. No. 5,039,617.

Liquids entering the cartridge can be modified in the capillary tracks or in an entry port prior to entry of sample into the capillary track to provide a sample better suited to a particular analysis. For example, blood can be filtered to provide plasma or lysed to provide a uniform, lysed medium. Filtration of red blood cells in capillary tracks is described in U.S. Pat. No. 4,753,776. The sample can also be lysed by passage through a porous disc, which contains an agent that lyses red cells (discussed in detail below). The "lysate" can then be distributed into one or more capillary tracks for the individual assays.

The assay system also comprises a monitor (analytical instrument) capable of reading at least one and usually more assays simultaneously. The monitor will therefore comprise detection systems and can also include verification systems (each of which can be a detection system utilized with different software or hardware in the detector or can be a separate system at various locations in the monitor) to detect any failure of the system. Monitors for performing single analyses are described in U.S. Pat. No. 4,756,884 and in U.S. application Ser. Nos. 016,506, filed Feb. 17, 1987, and 341,079, filed Apr. 20, 1989. Also, see U.S. Pat. No. 4,829,011 for a detector system that can be used in a monitor to detect agglutination of particles in a capillary track. These monitors can be readily adapted to use in the present invention simply by including a magnetic field generator, which can be a simple mechanically permanent magnet or an electromagnet generated mechanically or electronically. Motion is usually provided by moving the magnetic, but a moving electromagnetic field can be generated electromechanically (as in an electric motor) or entirely by electric or electronic switching of multiple electromagnetic elements.

When used to detect the presence, absence, or amount of a particular analyte in a mixed sample, the monitor is provided with appropriate analysis and verification systems. For a number of systems that can be used to determine whether analysis has occurred correctly in a cartridge inserted into an instrument (and therefore not visible to the user), see U.S. application Ser. No. 337,286, filed Apr. 13, 1989.

Other monitor systems and a number of types of disposable cartridges that could be used for one or more analyses are disclosed in U.S. Pat. No. 4,756,884, which is assigned to the assignee of the present application. Other devices and techniques are described in U.S. Pat. Nos. 4,946,795, 5,077,017, and 4,820,647.

Mixing operations can take place, if desired, in a capillary passageway containing a stop-flow junction that allows mixing to occur in a pre-selected location while flow is stopped, followed by flow to another chamber for further reaction. The phrase "stop-flow junction" refers to a control region in a capillary passageway that has been used in a number of prior inventions arising out of the laboratories of the inventors and in other laboratories (see, for example, U.S. Pat. Nos. 3,799,742 and 4,946,795 and U.S. application Ser. No. 07/663,217, filed Mar. 1, 1991). A stop-flow junction is a region in a fluid track that marks the junction between an early part of the track in which sample flows by capillary action (and optionally gravity) and a later part of the fluid track into which sample does not normally flow until flow is initiated by some outside force, such as an action of the user. For example, the stop-flow junction can be used to halt flow while the mixing operation takes place. When sufficient mixing has occurred, flow will be initiated so that other operations, such as measurement operations, can take place at locations further along the internal capillary passageway of the device. A number of stop-flow junctions are described in U.S. Pat. Nos. 4,868,129 and 5,077,017 and in application Ser. Nos. 07/337,286, filed Apr. 13, 1989, and 07/663,217, filed Mar. 1, 1991.

Not all devices of the invention will require a stop-flow junction. For example, the mixing can take place in the last chamber of a capillary passageway. If there is a need to optically examine the sample in the absence of the magnetic particles, the particles can be drawn to one side of the chamber after mixing using a linear motion imparted by a magnetic field. Alternatively, capillary flow through the device can be slowed rather than stopped by proper sizing of various capillary passageways by providing flow barriers as described in the previously cited patents and patent applications (especially U.S. Pat. Nos. 4,233,029 and 4,618,476). Additionally, changes in the surface energy characteristics of the capillary passageway surfaces can be used to slow flow. For example, making the surface more hydrophobic will reduce the flow rate when the sample is aqueous.

A linear magnetic field gradient can be used for purposes other than simple displacement of magnet particles. For example, the generation or motion of a magnetic field gradient and the resulting motion of the magnetic particles can be used, by selecting the proper orientation, to provide a starting impulse that overcomes a stop-flow barrier and allows capillary flow to continue to other portions of the apparatus. In such operations, the particles will typically be collected near the entrance passageway to the mixing chamber and then moved rapidly in the direction of the exit passageway that contains the stop-flow junction. The pressure imparted to the fluid will re-initiate capillary flow, and the particles will be stopped before they reach the exit to the mixing chamber, thus preventing the particles from being passed further along the passageway.

The necessary magnetic field for operation of the apparatus can be generated in any of the manners currently being used to generate magnetic fields (see above). When rotating, the magnetic field should ideally extend over the entire mixing chamber, but the magnetic field has no particular limitations other than being of sufficient strength and gradient to move the particles. Magnetic field strengths that result in successful operation can readily be determined empirically and are generally of the order provided by permanent magnets located 0.01 to 10 cm, preferably 0.3 to 4 cm, from the particles. There does not appear to be a limit on the low end of the movement rate other than to prove the desired rate of mixing. Even very slow movement will eventually result in complete mixing. Preferred rates of rotation of a rotating magnetic field that will ensure mixing within a time useful for most diagnostic systems are from 10 to 5,000 rotations per minute (rpm), more preferably 400 to 3,000 rpm, and most preferably about 1,000 rpm. There is no need to ensure that the axis of the rotating magnetic field passes through the geometric center of the chamber in which mixing has taken place. Satisfactory mixing can occur even when the axis of the rotating magnetic field does not pass through the mixing chamber at all. However, in preferred embodiments the axis of the rotating magnetic field does pass through the mixing chamber. Rotating permanent magnets, electromagnets, or electronically generated rotating magnetic fields can be used to provide the desired rotating motion.

For generation of linear magnetic field gradients that impart linear motion to the particles, the same types of magnetic field generators used for the rotating operation can be used. For example, a permanent magnet can be displaced linearly in either a regular, or random pattern by a mechanical operation. Alternatively, an electromagnet generated at a series of adjacent locations near the mixing chamber can be used for linear movement of the particles.

A typical mixing system of the invention comprises at least the chamber device with its various capillary passageways, chambers, and magnetic particles and a magnetic device containing the apparatus that generates the rotating magnetic field. The two components are designed so that the chamber device is retained in the magnetic device with the magnetic field and any analytical detectors oriented properly with respect to the chamber. There are no particular limitations on the shape of the chamber device or magnetic device as a whole, and the proper design of the magnetic field generator is a relatively minor design function in the design of the overall chamber device and monitor.

The invention now being generally described, the same will become more fully described by reference to the following detailed examples, which are provided for purposes of illustration only and is not to be considered limiting of the invention unless so specified.

EXAMPLES

Example 1

Cartridge Preparation

A circular reagent mixing chamber 0.012" deep and 0.28" diameter was milled into 0.06" thick ABS plastic. A capillary passageway with 0.06" width and 0.012" depth led to the chamber from a circular application site with diameter 0.18". A second capillary passageway, with width and depth both 0.01", on the opposite side of the chamber, provided a conduit for fluid leaving the chamber. A second, flat piece of 0.06" thick ABS plastic, ultrasonically welded to the first piece, completed the device.

Example 2

Mixing Device

Two small permanent magnets were mounted on the shaft of a small electric motor. The magnets were 0.2×0.2×0.25 inches, magnetized parallel to the long axis and made from Neodymium/Iron/Boron with peak energy 35 MGauss-Oersted. They were mounted symmetrically 0.6 inches apart (center-center) with their magnetic axis parallel to the axis of rotation and their poles directed in opposite senses. This device was set up 0.06 inches below the cartridge with the axis of rotation directed to the middle of the mixing chamber. The rotation rate was 1200 rpm. In mixing experiments, cartridges were placed on a flat stage registered to the mixer.

Example 3

Magnetically Inducible Particle Types

Selection criteria were as follows:

1) ability to mix blood in a capillary space with reagent within less than one minute using available magnets;

2) ability to be dispensed as a uniform dispersion; and 3) lack of hemolytic activity.

Table 1 describes the properties of the materials evaluated and results of tests according to the above criteria. As seen in table 1, magnetite satisfied all the preliminary selection criteria, being capable of more powerful mixing action than the Magic® particles and less hemolytic than Barium ferrite. Mixing efficiency was related to the content of the magnetic material of the particles, as only a fraction of the Magic® particles (specific density 2.5) is iron oxide, the rest being a polymer coating that is not magnetically active. In contrast, magnetite has a specific density of 5.2 and barium ferrite, 5.4.

TABLE 1

| | | Properties of magnetic materials | | | | |
|---|---|---|---|---|---|---|
| Material | Physical Form | Particle Size (micron) | Magnetic Susceptibility | Relative Permeability | Mixing Efficiency[1] | Lysis[2] (mg/dL) |
| Magic® Particles | brown slurry | 1–4 | 99 | 100 | poor | <100 |
| Magnetite | black powder | <3 | 99 | 100 | very good | <100 |
| Barium Ferrite | black powder | 2.5–4 | | | excellent | >500 |

[1]Visual inspection of particle and bulk flow movement.

[2]Whole blood samples mixed with suspensions of the particles are spun and the plasma visually inspected.

Example 4

Mixing with Magnetite

When magnetite was suspended in aqueous media in a capillary space and then exposed to a magnetic field from a powerful permanent magnet held close (<2 mm), particles clustered into aggregates up to several millimeter in length. When the fields were moved, as when the magnets were mounted on a rotating device as described above, the magnetite particle aggregated and moved following the motion of the magnets at speeds up to many cm/minute. This motion was quite sufficient to cause mixing of the suspending medium when amounts of magnetite equivalent to a few percent by volume of the chamber were used. The aggregates break up and re-form as they encounter resistance. Thus, they can be used to mix even in irregularly shaped spaces. It was confirmed that in a capillary space there is no motion that continues once the particles stop moving (in distinction to what happens in a stirred beaker). Accordingly, only the regions directly swept by the motion of the particles are mixed.

No limitation should be implied on the type of particles useful in the invention generally, as other samples would require a different optimum characteristics (e.g., non-blood samples would be indifferent to hemolytic properties).

Example 5

Mixing Demonstration 1

Into the oval capillary reagent chamber of an empty assay cartridge (Ciba Corning Diagnostics #473707) in which the dimensions of the reagent chamber were 0.003" deep and oval 0.12"×0.24", 5.5 microliters of 0.5 mM chlorophenol red dye (Aldrich 19,952-4) with 1.25 vol % magnetite particles (Johnson Matthey Electronics #12374) were introduced followed by 5.5 microliters of water. The distribution of dye was determined by reading absorbance values through a black mask with a small reading window (0.125" diameter) which was moved relative to the Ocartridge. Initially, almost all of the dye solution was at one end of the chamber. The dye and water were mixed by moving the magnetite with a magnetic stirrer (Corning, PC-353) for 30 seconds. The dye distribution, measured by absorbance again, was completely uniform across the oval.

TABLE 1

| | Absorbance (580 nm − 520 nm) × 1000 | |
|---|---|---|
| Section # | Before Mix | After Mix |
| 1 | 29 | 158 |
| 2 | 140 | 156 |
| 3 | 183 | 156 |
| 4 | 221 | 155 |
| 5 | 244 | 155 |
| 6 | 251 | 157 |

Example 6

Mixing Demonstration 2

A capillary cartridge with a hole for applying blood samples was prepared with a 0.012" deep chamber 0.28" in diameter reached by a capillary track 0.012" deep and 0.06" wide. A suspension of magnetite particles (Johnson Matthey Electronics #12374) was prepared in a reagent comprising components for precipitating LDL-cholesterol from plasma:

80 microliters LDL precipitation reagent (Ciba Corning Diagnostics 236141)

520 microliters water 6 mg bovine serum albumin (Sigma A-7030)

48 mg polyethylene glycol (Baker U221-8)

82 mg iron oxide (Johnson Matthey Electronics #12374)

The final concentration of magnetite particles was 2.7 vol %. Four microliters of this suspension were spread and dried onto the upper surface of the chamber.

Blood samples containing known amounts of total cholesterol and HDL-cholesterol were used as test samples. Sample flowed to the mixing site, where mixing took place. Blood was then allowed to continue to the assay site, where HDL-cholesterol was assayed. HDL-cholesterol remaining was measured downstream in a dry chemistry reflectance system. Incorrect concentration of the precipitating reagent caused by poor mixing would result in under-precipitation of LDL or partial precipitation of HDL. The assay results are shown in Table 2 as K/S values, which are linearly related to analyte concentration. K/S is calculated from the reflectance, R, of the membrane upon which the assay reaction has taken place when: K/S is defined as $(1-R)^2/2R$.

TABLE 2

| Sample No. | HDL-Cholesterol (actual concentration mg/dL) | Total Cholesterol (actual concentration mg/dL) | Measured Reflectance Cholesterol Signal (K/S) (average of 5 tests) |
|---|---|---|---|
| 1 | 47.3 | 210 | 0.750 |
| 2 | 56.1 | 152 | 0.958 |
| 3 | 60.5 | 182 | 1.017 |
| 4 | 66.0 | 213 | 1.189 |
| 5 | 67.1 | 165 | 1.261 |
| 6 | 96.0* | 96 | 2.38 |

Correlation of the K/S with HDL-cholesterol (R=0.99), as well as lack of correlation of the measured K/S values with the total cholesterol (P=0.18) in the original sample, show that the precipitation reagent is well mixed with the blood sample.

Example 7

Mixing Demonstration 3

As in Demonstration 2, but the cartridges were modified by scratching the capillary surface at the exit of the mixing chamber. Mixing was begun as soon as blood enters the capillary mixing chamber. Flow slowed as the sample mixed across scratcher, giving sufficient time for mixing. Results are shown in Table 3.

TABLE 3

| Sample No. | HDL-Cholesterol (actual mg/dL) | Measured Reflectance Signal (K/S) |
|---|---|---|
| 1 | 0.787 | 44 |
| 2 | 0.834 | 51 |
| 3 | 1.304 | 67 |

Again, correlation of the K/S with HDL-cholesterol (R=0.98) shows that the precipitation reagent was well mixed with the blood sample.

All publications and patent applications cited in this specification are herein incorporated by reference as if each individual publication or patent application were specifically and individually indicated to be incorporated by reference.

Although the foregoing invention has been described in some detail by way of illustration and example for purposes of clarity of understanding, it will be readily apparent to those of ordinary skill in the art in light of the teachings of this invention that certain changes and modifications my be made thereto without departing from the spirit or scope of the appended claims.

What is claimed is:

1. A system capable of carrying out mixing in a capillary chamber, comprising:

a. a chamber device, comprising:
  i. a liquid impervious housing;
  ii. a chamber in said housing having capillary spacing in one dimension and non-capillary spacing in other dimensions; and
  iii. a plurality of magnetic or magnetically inducible particles in said chamber; and b. a magnetic device, comprising:
  i. means for generating a moving magnetic field; and
  ii. means for retaining said chamber device in an orientation so that said moving magnetic field causes said particle to move in said chamber over a distance sufficient to effect mixing.

2. The system of claim 1, wherein in said chamber device, said chamber is part of a capillary passageway comprising an entry port in a surface of said housing, a pre-chamber passageway leading from said entry port to said capillary chamber, and a vent, wherein said vent is located in said chamber or in a post-chamber passageway that is connects said vent to said chamber.

3. The system of claim 1, wherein said magnetic device further comprises an optical detection system oriented to interrogate said chamber device at a location in said post-chamber passageway.

4. The system of claim 1, wherein said magnetic device comprises means for generating a magnetic field that imparts rotational motion to said particles.

5. The system of claim 1, wherein said magnetic device comprises means for generating a magnetic field that imparts linear motion to said particles.

6. The system of claim 5, wherein said magnetic means comprises collection means for causing said magnetic field to collect said particles into a sub-region of said y chamber.

7. The system of claim 6, wherein said chamber device further comprises a stop flow junction that prevents flow of a liquid in said chamber past said junction when said liquid is under the influence of solely capillary and gravitational forces and said linear motion is selected to cause a liquid in said capillary passageway to flow past said stop flow junction.

8. A capillary mixing device, comprising:

a. a liquid impervious housing;

b. an interior space in said housing comprising:
  i. a chamber in said housing having capillary spacing in one dimension and non-capillary spacing in other dimensions; and,
  ii. first and second capillary passageways in said housing connected to said chamber; and c. a plurality of magnetic or magnetically inducible particles in said chamber.

9. The device of claim 8, wherein substantially all of said particles are smaller than a magnetic domain.

10. The device of claim 8, wherein said capillary spacing is from 0.01 to 2 mm.

11. The device of claim 8, wherein said particles occupy from 1 to 5% of the volume of said chamber.

12. The device of claim 8, wherein said particles have a density of at least 4 g/cc.

13. The device of claim 8, wherein said particles comprise magnetite in a polymeric coating.

14. The device of claim 8, wherein said particle consist essentially of magnetite or barium ferrite.

15. A method of mixing in a capillary chamber, comprising:

a. adding a liquid to be mixed to a mixing device comprising:

i. a liquid impervious housing;

ii. a chamber in said housing having capillary spacing in one dimension and non-capillary spacing in other dimensions; and iii. a plurality of magnetic or magnetically inducible particles in said chamber; and b. generating a rotating magnetic field in said chamber.

16. The method of claim 15, wherein said magnetic field rotates at an angular velocity of from 400 to 3000 rpm.

17. The method of claim 15, wherein said magnetic field is generated by physically rotating a permanent magnet.

18. The method of claim 15, wherein the axis of said rotating magnetic passes through said chamber.

19. The method of claim 15, wherein said particles are present in said capillary chamber prior to adding said liquid to be mixed.

20. The method of claim 19, wherein said particles are present in a reagent composition soluble or dispersible in said liquid.

21. The method of claim 15, wherein said particles are introduced into said chamber concurrently with a liquid to be mixed in said capillary chamber.

* * * * *